US005799909A

United States Patent [19]

Ziegler

[11] Patent Number: 5,799,909

[45] Date of Patent: Sep. 1, 1998

[54] CONTAINMENT SYSTEM FOR RECEIVING AND DISPOSING OF DISPOSABLE SANITARY PRODUCTS

[76] Inventor: Scott W. Ziegler, 932 Vista Del Monte Way, El Cajon, Calif. 92020

[21] Appl. No.: 738,418

[22] Filed: Oct. 25, 1996

[51] Int. Cl.[6] ..... B65B 67/04

[52] U.S. Cl. ..... 248/101; 248/907; 220/335; 220/481; 220/908; 220/87.1

[58] Field of Search ..... 248/99, 101, 95, 248/97, 98, 907; 220/404, 335, 480, 481, 482, 908, 87.1

[56] References Cited

U.S. PATENT DOCUMENTS

| | | | |
|---|---|---|---|
| 1,414,575 | 5/1922 | McCart | 248/97 |
| 1,470,686 | 10/1923 | Carpenter | 220/335 |
| 1,985,587 | 12/1934 | Storrs, Jr. | 220/335 |
| 2,802,590 | 8/1957 | Tupper | 220/87.1 X |
| 3,218,014 | 11/1965 | Frazier | 220/404 X |
| 4,124,185 | 11/1978 | Preisinger | 248/101 X |
| 4,325,492 | 4/1982 | Kunze | 220/335 |
| 4,955,566 | 9/1990 | Bolich | 248/101 |
| 5,020,751 | 6/1991 | Larkin | 248/99 |
| 5,385,259 | 1/1995 | Berstein et al. | 220/404 |
| 5,535,913 | 7/1996 | Asbach et al. | 220/404 |
| 5,647,502 | 7/1997 | Marsh | 220/481 |

*Primary Examiner*—Ramon O. Ramirez
*Assistant Examiner*—Stephen S. Wentsler
*Attorney, Agent, or Firm*—Stetina Brunda Garred & Brucker

[57] ABSTRACT

A containment system for receiving and disposing of disposable sanitary products. The containment system comprises a peripheral frame member which defines a central opening. Releasably attached to the frame member and suspended therefrom is a containment bag which defines a hollow interior communicating with the central opening of the frame member when the containment bag is attached thereto. Pivotally connected to the frame member is a lid member which is movable between a closed position whereat the lid member blocks the central opening, and an open position whereat disposable sanitary products are passable through the central opening of the frame member into the interior of the containment bag. Attached to and extending between the frame member and the lid member is a biasing mechanism for normally maintaining the lid member in the closed position. The height of the frame member is significantly less than the length of the containment bag such that a substantial portion of the containment bag protrudes downwardly from and is not covered by the frame member.

10 Claims, 4 Drawing Sheets

Fig. 1
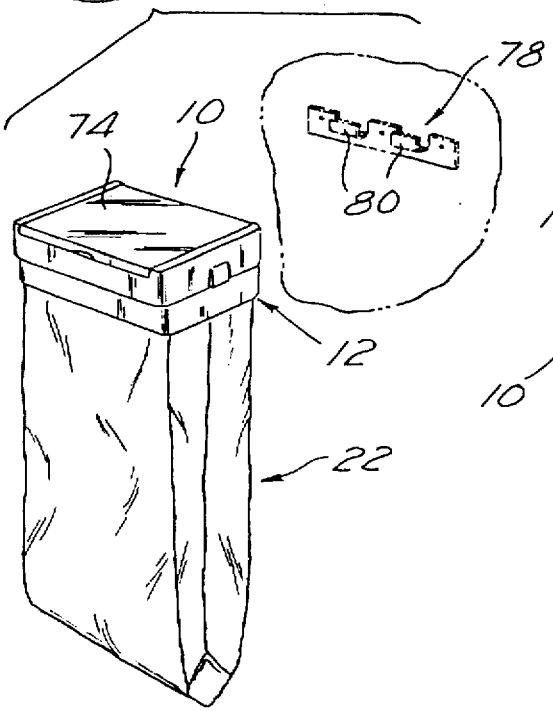
Fig. 2
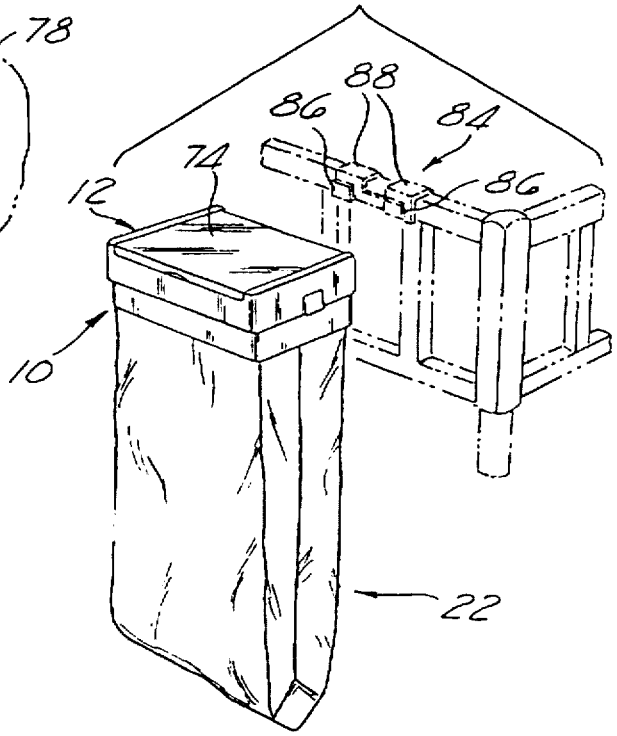
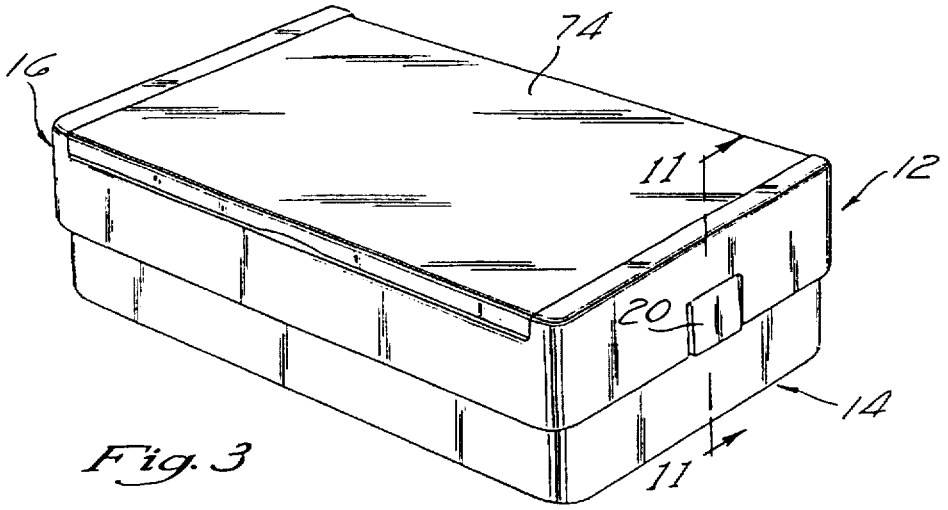
Fig. 3

Fig. 4
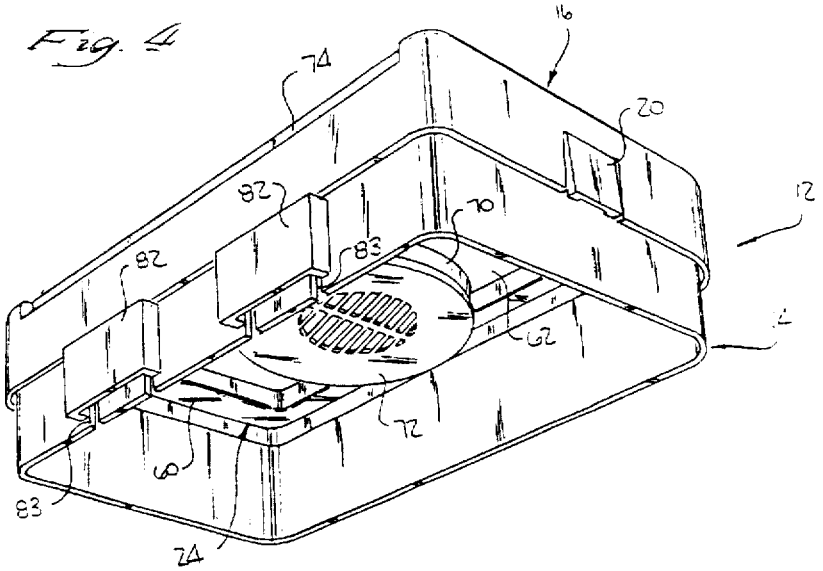
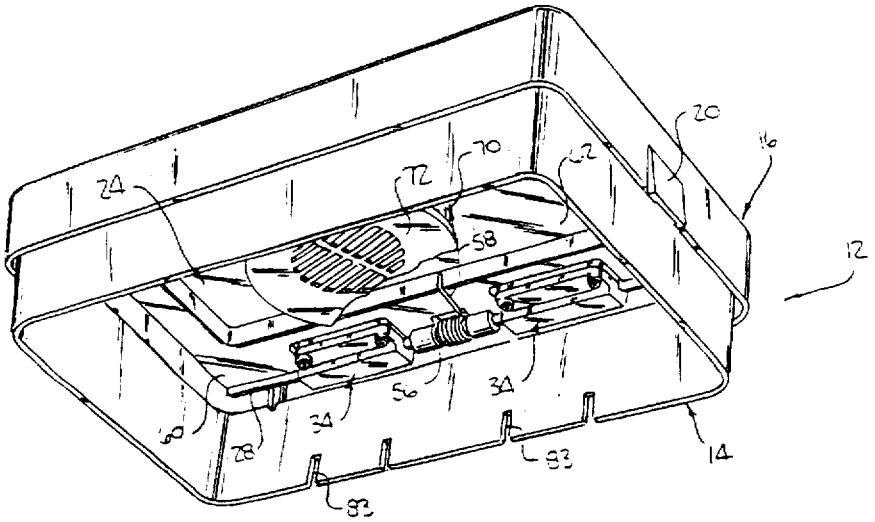
Fig. 5

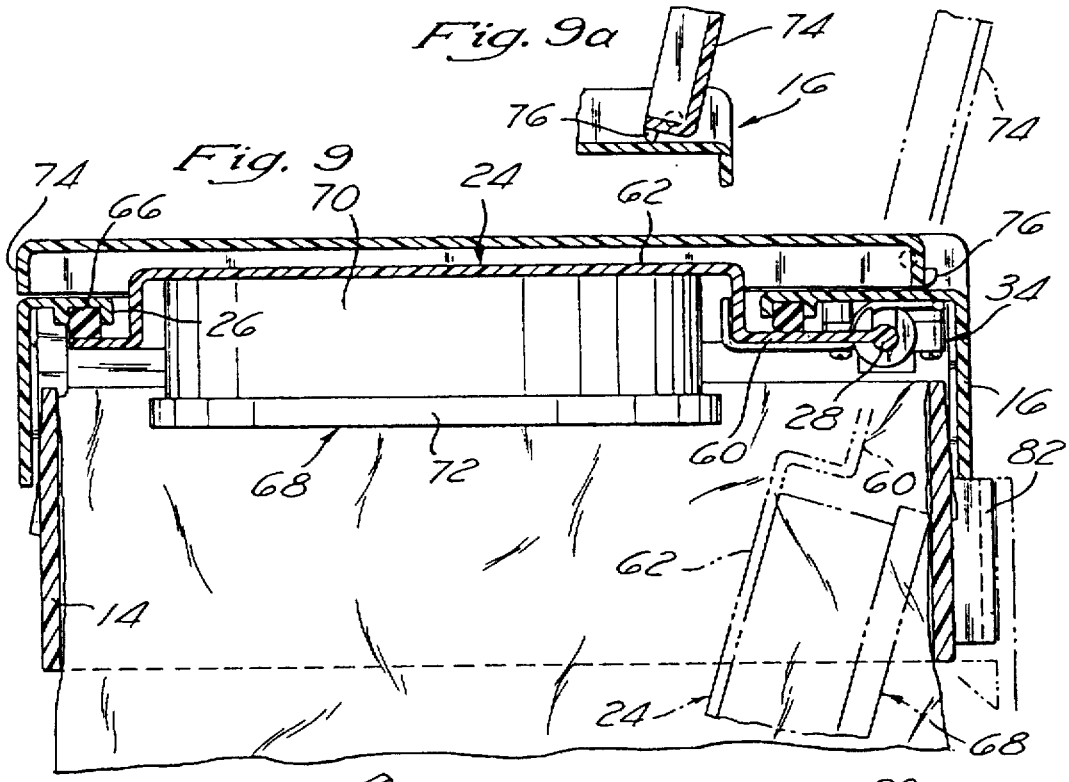
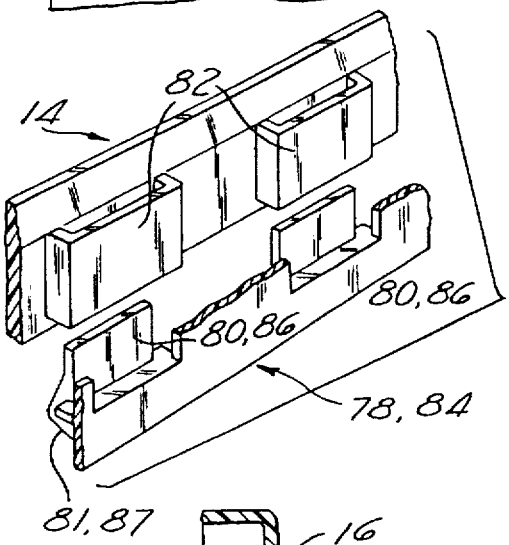
Fig. 10
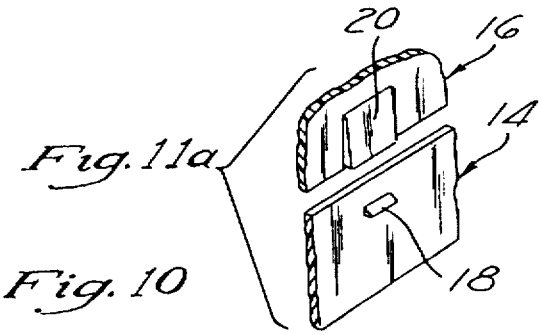
Fig. 11a
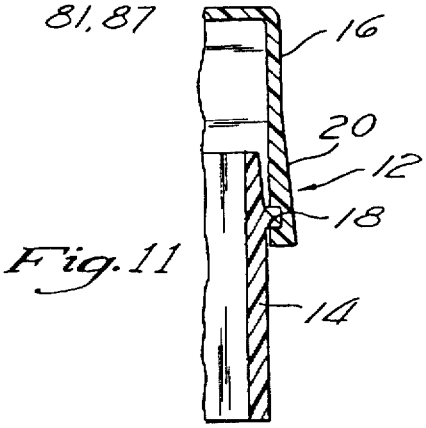
Fig. 11
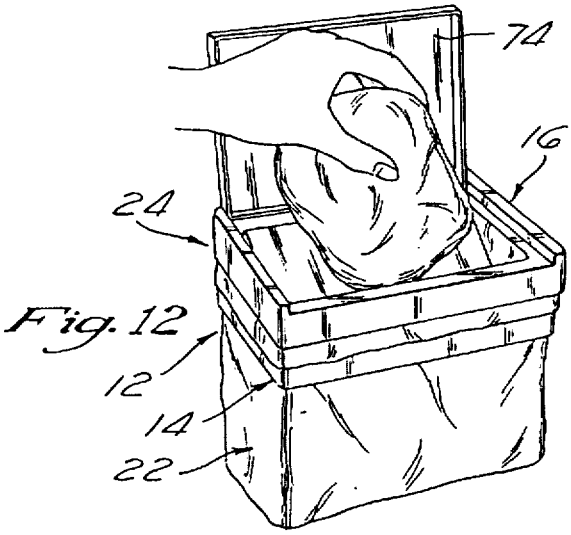
Fig. 12

CONTAINMENT SYSTEM FOR RECEIVING AND DISPOSING OF DISPOSABLE SANITARY PRODUCTS

FIELD OF THE INVENTION

The present invention relates generally to storage devices, and more particularly to a containment system for receiving and disposing of disposable sanitary products, such as diapers.

BACKGROUND OF THE INVENTION

Frequently found in the bathroom or nursery of a household having an infant or very young child is a device commonly referred to as a "diaper pail" which is used for the receipt and disposal of disposable baby diapers. Diaper pails constructed in accordance with the prior art typically comprise a large garbage can-like container which is adapted to receive a flexible plastic bag similar to a conventional trash bag. The bag is typically inserted into the interior of the container, with the upper portion thereof being folded over the top rim of the container to maintain the bag in engagement thereto. These prior art diaper pails are also provided with a cover member which is movable between open and closed positions. When in the closed position, the cover member is advanced over the top rim of the container, thus enclosing the open end of the bag therewithin. When the cover member is in its open position, the open end of the bag is uncovered, thus allowing diapers to be placed into the interior thereof. The container of these prior art diaper pails is often provided with a foot pedal which is cooperatively engaged to the cover member for allowing the same to be moved between its open and closed positions via the actuation of the foot pedal.

In addition to the aforementioned diaper pails, there is also known in the prior art a popular diaper disposal apparatus currently sold under the trademark "Diaper Genie". This particular disposal apparatus comprises a cylindrically configured containment vessel having a closure member pivotally connected to the bottom end thereof. Disposed in the top end of the containment vessel is a cylindrically configured reservoir which is lined with a layer of flexible, plastic material and is adapted to receive a disposable diaper. Subsequent to the insertion of the diaper thereinto, the reservior is rotated, thus causing the diaper to be effectively encapsulated in the plastic material, and the reservoir to be lined with a new layer of plastic material. The subsequent insertion of another diaper into the reservoir causes the previously encapsulated diaper to be dropped into the hollow interior of the containment vessel. Once filled, the containment vessel is emptied by opening the closure member at the bottom end thereof.

Though the above-described disposal devices provide for the disposal of diapers, perhaps the largest draw back associated with there use is the relatively large size thereof. In this respect, the floor space occupied by such disposal devices is roughly equal to that occupied by a medium sized trash can. In this respect, in relatively small rooms, and in particular bathrooms, it is often difficult to find a convenient, out of the way location for the disposal device. Additionally, the relatively large size of the container or containment vessel of the prior art disposal devices prevents the same from being mounted to a wall or suspended from a crib rail or diaper table side rail.

The present invention overcomes the shortcomings of prior art diaper disposable devices by providing a small, compact containment system which is specifically adapted to be mounted to a vertically oriented support surface such as a wall, or alternatively suspended from a horizontally extending support structure such as a crib rail or changing table side rail. In the present containment system, no large, bulky container or containment vessel is provided. Rather, a substantial portion of the present containment system is defined by the disposable, flexible containment bag thereof.

SUMMARY OF THE INVENTION

In accordance with the present invention, there is provided a containment system for the receipt and disposal of disposable sanitary products, such as diapers. The containment system comprises a peripheral frame member having a base section, and a top section which defines a central opening and is releasably attached to the base section. The releasable attachment of the top and base sections to each other is facilitated by the engagement of a pair of flexible tab portions formed on the top section to respective ones of a pair of connector lugs formed on the base section.

In addition to the frame member, the containment system comprises a containment bag which is releasably attached to the frame member and suspended therefrom. More particularly, the containment bag is frictionally captured between the top and base sections of the frame member when attached to each other. The containment bag defines a hollow interior which communicates with the interior of the frame member and, at times, the central opening of the top section when the containment bag is attached to the frame member. Importantly, the height of the frame member is significantly less than the length of the containment bag such that a substantial portion of the containment bag protrudes downwardly from and is not covered by the frame member. As such, in the containment system constructed in accordance with the present invention, the containment bag remains substantially exposed.

The containment system of the present invention further comprises an internal lid member which is pivotally connected to the top section of the frame member and is movable between a closed position whereat the lid member blocks the central opening defined by the top section, and an open position whereat disposable sanitary products are passable through the central opening into the interior of the containment bag. The top section of the frame member preferably includes a ceiling gasket attached thereto, with the lid member being abutted against the ceiling gasket when in the closed position for facilitating an odor-tight seal of the central opening. Integrally formed on the lid member is a fragrance container which resides within the interior of the frame member when the lid member is in the closed position. The fragrance container includes a perforated cover plate which is removably attached thereto and encloses a hollow reservoir defined thereby.

The containment system of the present invention further comprises a cover member which is pivotally connected to the top section of the frame member and movable between a first position whereat the lid member is covered thereby, and a second position whereat the lid member is exposed. As such, the lid member is movable to its open position to facilitate the passage of disposable sanitary products into the interior of the containment bag only when the cover member is moved to its second position. The cover member includes at least one, and preferably a pair of retention tabs formed thereon for frictionally maintaining the cover member in the second position.

Attached to and extending between the top section of the frame member and the lid member is a biasing mechanism for normally maintaining the lid member in the closed position. The biasing mechanism itself comprises a rod member which is attached to the lid member and a coil spring which is disposed on the rod member. The coil spring itself includes a first end which is abutted against the lid member and a second end which is abutted against the top section of the frame member.

In addition to the above-described components, the containment system of the present invention comprises a mounting bracket which is releasably attached to the base section of the frame member for facilitating the attachment of the frame member to a vertically oriented support surface, such as a wall. As an alternative to the mounting bracket, the containment system may further comprise a hanger member which is releasably attached to the base section of the frame member for facilitating the suspension of the frame member from a horizontally extending support structure, such as a crib rail or a changing table side rail. The various components of the containment system, including the top and base sections of the frame member, the lid member, the cover member, and the mounting bracket or hanger member, are each preferably fabricated from a plastic material.

BRIEF DESCRIPTION OF THE DRAWINGS

These, as well as other features of the present invention, will become more apparent upon reference to the drawings wherein:

FIG. 1 is a perspective view of the containment system of the present invention, illustrating a mounting bracket which may be included therewith for facilitating the attachment thereof to a vertically oriented support surface;

FIG. 2 is a perspective view of the containment system of the present invention, illustrating a hanger member which may be included therewith for facilitating the suspension thereof from a horizontally extending support structure;

FIG. 3 is a front, top perspective view of the containment system of the present invention;

FIG. 4 is a rear, bottom perspective view of the containment system of the present invention;

FIG. 5 is a front, bottom perspective view of the containment system of the present invention;

FIG. 9 is a cross-sectional view of the containment system of the present invention;

FIG. 9*a* is a partial cross-sectional view illustrating the manner in which the retention tabs of the cover member frictionally engage the frame member of the containment system;

FIG. 10 is an exploded view illustrating the manner in which the mounting bracket or hanger member shown in FIGS. 1 and 2 are releasably attached to the frame member of the containment system;

FIG. 11 is a partial cross-sectional view illustrating the manner in which the top and base sections of the frame member of the containment system are releasably engaged to each other;

FIG. 11*a* is an exploded view of the top and base sections.f the frame member shown in FIG. 11; and FIG. 12 is a partial perspective view illustrating the manner in which a disposable sanitary product is placed into the containment system of the present invention.

DETAILED DESCRIPTION OF THE PREFERRED EMBODIMENT

Figure 6:
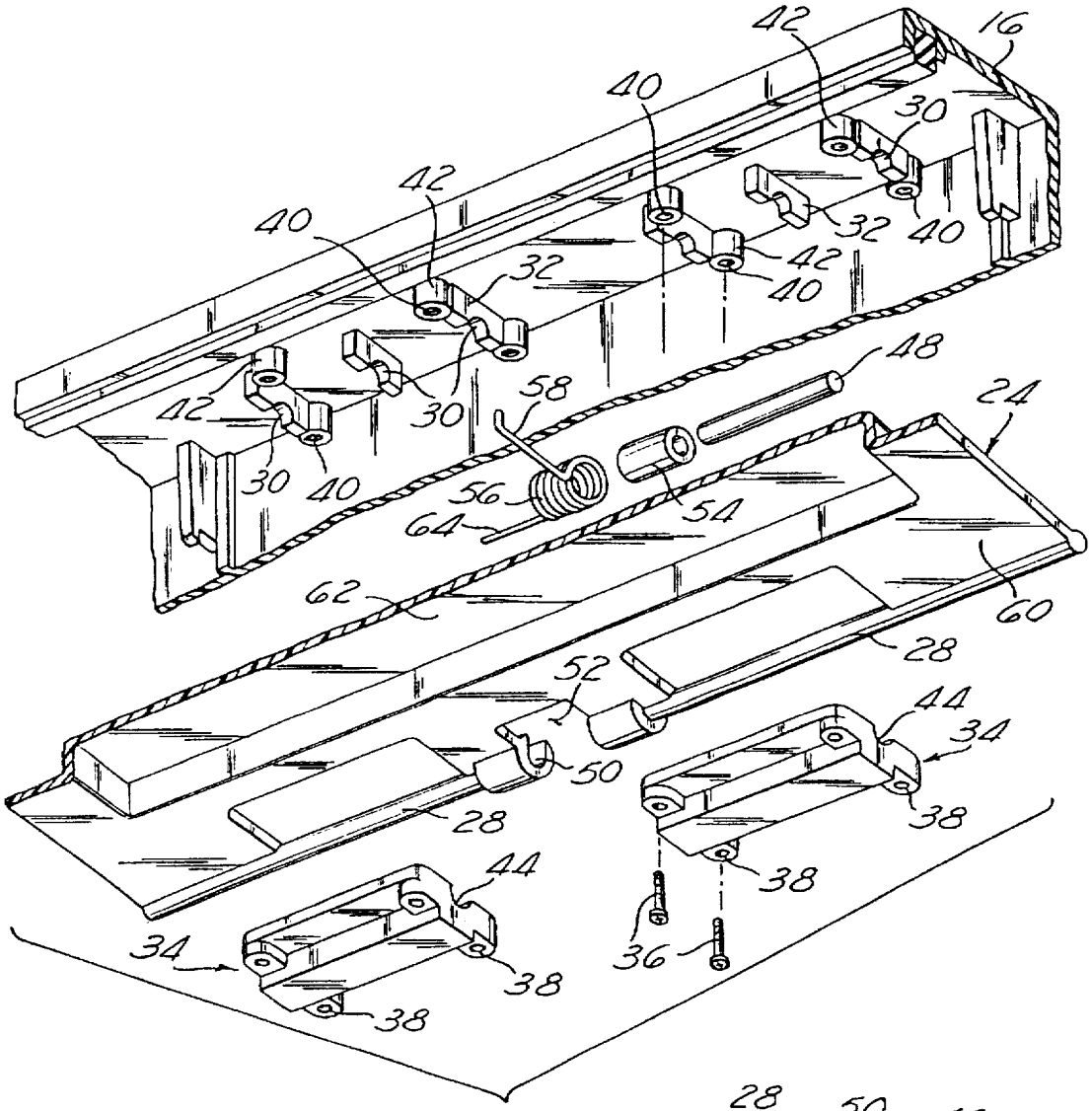
FIG. 6 is an exploded view illustrating the manner in which the lid member and biasing mechanism of the containment system are pivotally connected to the frame member thereof.

Referring now to the drawings wherein the showings are for purposes of illustrating preferred embodiments of the present invention only, and not for purposes of limiting the same, FIGS. 1 and 2 perspectively illustrate the containment system 10 constructed in accordance with the present invention. The containment system 10 is adapted to receive and dispose of disposable sanitary products, such as diapers. Though the containment system 10 will hereinafter be described in relation to its primary application for the disposal of disposable diapers, it will be recognized that the same also finds utility in relation to the disposal of other disposable sanitary products as well.

Referring now to FIGS. 1–5 and 9, the containment system 10 of the present invention comprises a peripheral frame member 12 which has a generally rectangular, loop-like configuration. The frame member 12 itself comprises a base section 14 and a top section 16 which is releasably attached to the base section 14.

Referring now to FIGS. 9, 11 and 11*a*, the base section 14 of the frame member 12 defines opposed longitudinal and lateral sides, with each of the lateral sides including a centrally positioned, elongate connector lug 18 extending outwardly therefrom. Like the base section 14, the top section 16 of the frame member 12 defines opposed longitudinal and lateral sides, with each of the lateral sides including a centrally positioned, flexible tab portion 20 formed thereon adjacent the bottom edge thereof. In the frame member 12, the releasable attachment of the base and top sections 14, 16 to each other is facilitated by the engagement of the tab portions 20 to respective ones of the connector lugs 18. In this respect, the top section 16 is detached from the base section 14 by flexing the tab portions 20 outwardly so as to remove the connector lugs 18 from therewithin, and subsequently pulling the top section 16 upwardly relative to the base section 14. The re-attachment of the top section 16 to the base section 14 is accomplished by pushing the top section 16 downwardly over the base section 14 such that the connector lugs 18 are re-inserted into the complementary notches formed within the inner surfaces of respective ones of the tab portions 20.

In addition to the frame member 12, the containment system 10 of the present invention comprises a containment bag 22 which is adapted to be releasably attached to the frame member 12 and suspended therefrom. The releasable attachment of the containment bag 22 to the frame member 12 is facilitated by initially removing the top section 16 of the frame member 12 from the base section 14 thereof. Thereafter, the containment bag 22 is disposed within the hollow interior of the base section 14, with the upper portion thereof defining the open top end of the containment bag 22 being folded over the top rim of the base section 14. The top section 16 is then re-attached to the base section 14 in the aforementioned manner, thus frictionally capturing the upper portion of the containment bag 22 therebetween such that the remainder of the containment bag 22 is suspended from the frame member 12. Importantly, as is best seen in FIGS. 1 and 2, the height of the frame member 12 is significantly less than the length of the containment bag 22.

As such, a substantial portion of the containment bag 22 protrudes downwardly from and is not covered by the frame member 12 (i.e., is exposed) when the containment bag 22 is releasably attached to the frame member 12 in the aforementioned manner.

The detachment of the containment bag 22 from the frame member 12 is accomplished by initially removing the top section 16 from the base section 14. Thereafter, the containment bag 22 is grasped and pulled downwardly, thus removing the upper portion thereof from about the base section 14. The containment bag 22 is preferably fabricated from a flexible plastic material, and may be scented. Additionally, though not shown, the containment bag 22 may be provided with external markings which assist the user in determining when the containment bag 22 is full and/or when a sufficient amount of the upper portion thereof protrudes upwardly beyond the base section 14 so as to be folded thereover in a manner properly attaching the containment bag 22 to the frame member 12. As seen in FIGS. 1, 2 and 12, when properly attached to the frame member 12, the top rim of the containment bag 22 defining the open end thereof will normally protrude from between the base and top sections 14, 16.

Referring now to FIGS. 4–6 and 9, the containment system 10 of the present invention further comprises a rectangularly configured, internal lid member 24 which is pivotally connected to the top section 16 of the frame member 12. In this respect, the lid member 24 resides within a complementary, rectangularly configured central opening 26 defined within the top section 16, and is moveable between a closed position whereat the lid member 24 blocks the central opening 26, and an open position whereat disposable sanitary products such as diapers are passable through the central opening 26 into the hollow interior of the containment bag 22 which communicates with the central opening 26 when the containment bag 22 is attached to the frame member 12.

As best seen in FIGS. 5, 6 and 9, the pivotal connection of the lid member 24 to the top section 16 is facilitated by the receipt of a linearly aligned pair of enlarged, circularly configured beads 28 extending along a common longitudinal edge of the lid member 24 into the complementary, semi-circular notches 30 disposed within bosses 32 integrally formed on and extending downwardly from the inner surface of the top section 16 adjacent the central opening 26 defined therewithin. Once received into the notches 30, the beads 28 are maintained therewithin by a pair of retaining plates 34 which are rigidly engaged to respective ones of the bosses 32 via fasteners 36 such as screws. In this respect, each of the retaining plates 34 includes four (4) apertures 38 disposed therein which are adapted to facilitate the passage of the fasteners 36 therethrough. Subsequent to being extended through the apertures 38 of each retaining plate 34, the fasteners 36 are received into corresponding internally threaded apertures 40 disposed within cylindrically configured bosses 42 which are also integrally formed on and extend downwardly from the inner surface of the top section 16 adjacent certain ones of the bosses 32. Each retaining plate 34 includes a semi-circular channel 44 extending longitudinally therethrough which receives that portion of a respective bead 28 not disposed within a corresponding set of notches 30. As will be recognized, the attachment of the retaining plates 34 to the bosses 42 in the aforementioned manner maintains the beads 28 within the openings collectively defined by the semi-circular notches 30 and channels 44, with the beads 28 being pivotally movable (i.e., rotatable) within such openings.

Figure 7:
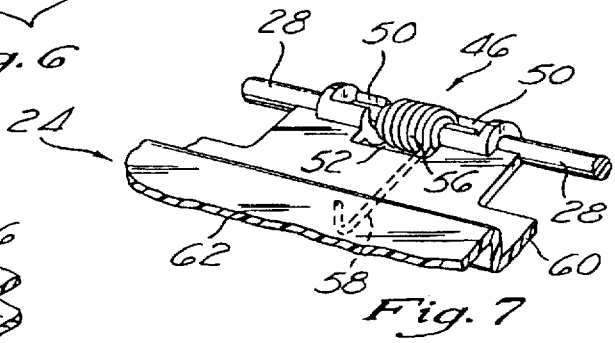
FIG. 7 is a partial perspective view of the biasing mechanism of the containment system of the present invention.

Referring now to FIGS. 6, 7 and 9, the lid member 24 is normally maintained in its closed position by a biasing mechanism 46 which is attached to the lid member 24 and extends between the lid member 24 and the top section 16 of the frame member 12. In the containment system 10, the biasing mechanism 46 comprises an elongate rod member 48 which is inserted into and extends between a spaced pair of slots 50 formed at the inner ends of respective ones of the beads 28. In this respect, the slots 50 are separated by a cut-out 52 formed in the lid member 24 therebetween. The biasing mechanism 46 further comprises a tubular, cylindrical sleeve member 54 which is disposed on the rod member 48 and centrally positioned thereon. Advanced over and positioned upon the sleeve member 54 is the main body of a coil spring 56.

When the biasing mechanism 46 is properly interfaced to the lid member 24, both the sleeve member 54 and coil spring 56 reside within the cut-out 52 between the slots 50, with the opposed end portions of the rod member 48 being received into respective ones of the slots 50. As best seen in FIGS. 5, 7 and 9, the coil spring 56 defines a first end portion 58 which extends radially relative to the main body thereof and includes an upwardly turned distal end. In this respect, the first end portion 58 extends along the inner surface of a peripheral flange portion 60 of the lid member 24, with the distal end extending upwardly into and along the inner surface of a recessed central portion 62 of the lid member 24. In addition to the first end portion 58, the coil spring 56 defines a substantially straight second end portion 64 which extends in generally parallel relation to the axis of the main body thereof. The second end portion 64 extends along the inner surface of the top section 16 of the frame member 12 when the lid member 24 (including the biasing mechanism 46) is pivotally connected to the top section 16 in the aforementioned manner. It will be recognized that the pivotal connection of the lid member 24 to the top section 16 maintains the biasing mechanism 46, and in particular the rod member 48 thereof, within the slots 50.

As best seen in FIG. 9, when the lid member 24 is biased to its closed position by the biasing mechanism 46, the central portion 62 thereof extends upwardly through the central opening 26 within the top section 16 and protrudes slightly beyond the top, outer surface of the top section 16. In this respect, the application of downward pressure to the exposed outer surface of the central portion 62 facilitates the downward pivotal movement of the lid member 24 in the manner shown in FIG. 9, thus unblocking the central opening 26 and allowing disposable sanitary products to be passed therethrough into the hollow interior of the containment bag 22. When such downward pressure is removed from the outer surface of the central portion 62, the biasing mechanism 46 biases the lid member 24 back to its normal, closed position, thus covering (i.e., blocking) the central opening 26.

As further seen in FIG. 9, formed within the bottom, inner surface of the top section 16 is a continuous channel which circumvents the central opening 26. Disposed within this channel is a ceiling gasket 66 which has a generally square cross-sectional configuration and protrudes downwardly beyond the opposed sides of the channel. Importantly, when the lid member 24 is in its closed position, the outer surface of the peripheral flange portion 60 thereof is abutted against the ceiling gasket 66. Importantly, such abutment facilitates the formation of an odor-tight seal between the lid member 24 and the frame member 12, which prevents undesirable odors from diapers stored within the containment bag 22 from escaping through the central opening 26 of the top section 16.

As best seen in FIGS. 4, 5 and 9, to further assist in the reduction of odor from within the containment system 10, the lid member 24 is preferably provided with a fragrance container 68 which is integrally formed on the inner surface on the recessed central portion 62 thereof. The fragrance container 68 comprises a cylindrically configured housing 70 which defines a hollow reservoir adapted to receive a deodorizing element. In addition to the housing 70, the fragrance container 68 includes a circularly configured, perforated cover plate 72 which is removably attached to the bottom, distal rim of the housing 70 and encloses the reservoir defined thereby. When the lid member 24 is in its closed position, the fragrance container 68 protrudes downwardly slightly into the interior of the base section 14. As previously indicated, in addition to including the ceiling gasket 66 and fragrance container 68 to control odor, the containment bag 22 used in the containment system 10 may itself be scented to provide further odor control.

Figure 8:
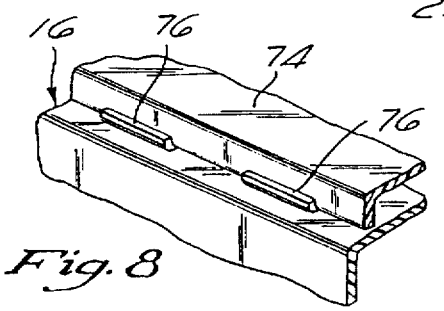
FIG. 8 is a partial perspective view of the retention tabs formed on the cover member of the containment system of the present invention.

Referring now to FIGS. 3, 8, 9, 9*a* and 12, the containment system 10 constructed in accordance with the present invention further comprises a rectangularly configured cover member 74 which is pivotally connected to the top section 16 of the frame member 12. The cover member 74 is movable between a first position (shown in FIGS. 3 and 9) whereat the lid member 24 is covered thereby, and a second position (shown in FIG. 12) whereat the lid member 24, and in particular the central portion 62 thereof, is exposed. As best seen in FIGS. 8 and 9*a*, the cover member 74 includes at least one, and preferably a pair of retention tabs 76 formed along one of the longitudinal edges thereof in spaced relation to each other. The retention tabs 76 are adapted to frictionally engage the top section 16 of the frame member 12 when the cover member 74 is in its second position for purposes of maintaining the cover member 74 in the second position. The frictional engagement of the retention tabs 76 to the top section 16 is easily overcome by pulling the cover member 74 downwardly toward the lid member 24. As best seen in FIGS. 3 and 12, the top edges of the longitudinal sides of the top section 16 are preferably recessed relative to the top edges of the lateral sides thereof such that the top surface of the cover plate 72 is substantially flush with the top edges of the lateral sides of the top section 16 when the cover member 74 is in its closed, first position.

Referring now to FIGS. 1, 9 and 10, the containment system 10 of the present invention further comprises an elongate mounting bracket 78 which is used to facilitate the attachment of the containment system 10, and in particular the frame member 12 thereof, to a vertically oriented support surface such as a wall. The mounting bracket 78 includes a spaced pair of upwardly extending, rectangularly configured flange portions 80 which are laterally off-set relative to the remainder thereof. The flange portions 80 are sized and configured to be slidably inserted into respective ones of a corresponding pair of loop portions 82 integrally formed on the outer surface of the rear longitudinal side of the base section 14. The flange portions 80 of the mounting bracket 78 each include a pair of outwardly projecting, inclined regions 81 formed thereon along respective ones of the opposed vertical sides thereof. The inclined regions 81 are adapted to be receivable into respective ones of a series of elongate notches 83 which are formed in the bottom edge of the rear longitudinal sidewall of the base section 14. The receipt of the inclined regions 81 into the notches 83 occurs concurrently with the insertion of the flange portions 80 into the loop portions 82 and strengthens the connection between the frame member 12 and the mounting bracket 78.

To facilitate the mounting of the containment system 10 to the wall, the mounting bracket 78 is initially secured to the wall via the extension of fasteners such as screws through respective ones of three (3) apertures disposed therein. Thereafter, the loop portions 82 are downwardly advanced over respective ones of the flange portions 80 with the inclined regions 81 being received into the notches 83, thus facilitating the releasable attachment of the frame member 12 to the mounting bracket 78. As will be recognized, the mounting bracket 78 must be disposed upon the wall at an elevation such that when the frame member 12 is attached thereto in the aforementioned manner, the closed bottom end of the containment bag 22 is separated from the floor.

Referring now to FIGS. 2, 9 and 10, as an alternative to the previously described mounting bracket 78, the containment system 10 may comprise a hanger member 84 for facilitating the suspension of the frame member 12 from a horizontally extending support structure such as a crib rail (as shown in FIG. 2) or the side rail of a changing table. Like the mounting bracket 78, the hanger member 84 is formed to include a spaced pair of rectangularly configured, upwardly extending flange portions 86 which are laterally off-set relative to the remainder of the hanger member 84. The flange portions 86 of the hanger member 84 themselves each include a pair of outwardly projecting, inclined regions formed thereon along respective ones of the opposed vertical sides thereof. The inclined regions of the flange portions 86 are configured identically to the inclined regions 81 of the flange portions 80. Like the inclined regions 81 of the flange portions 80, the inclined regions of the flange portions 86 are adapted to be received into respective ones of the notches 83 for strengthening the connection between the frame member 12 and the hanger member 84.

To facilitate the releasable attachment of the frame member 12 to the hanger member 84, the flange portions 86 are slidably inserted into respective ones of the loop portions 82, with the inclined regions thereof being concurrently inserted into respective ones of the notches 83. In addition to the flange portions 86, the hanger member 84 includes a spaced pair of generally U-shaped mounting portions 88 which are adapted to be extensible over the crib rail, changing table side rail, or other horizontally extending support structure. As such, through the use of either the mounting bracket 78 or hanger member 84, the containment system 10 of the present invention is not placed upon the floor, but rather is mounted either directly to a wall, or suspended from a piece of nursery furniture.

In the containment system 10 constructed in accordance with the present invention, the frame member 12 (including the base and top sections 14, 16), the lid member 24 (including the fragrance container 68), the cover member 74, the mounting bracket 78, and the hanger member 84 are each preferably fabricated from a white colored plastic material. However, those of ordinary skill in the art will recognize that alternative materials in alternative colors may be employed in the fabrication of the containment system 10.

Referring now to FIG. 12, once the containment system 10 has been mounted to either a wall or a piece of nursery furniture, the same is used to facilitate the disposal of a diaper or other disposable sanitary product by initially moving the cover member 74 to its second position exposing the lid member 24. Thereafter, the diaper or other disposable sanitary product is pushed against the outer surface of the central portion 62 of the lid member 24, thus overcoming the biasing force exerted thereagainst by the biasing mechanism 46, and moving the lid member 24 to its open position. The diaper or other disposable sanitary product is then simply dropped into the interior of the containment bag 22, with the biasing mechanism 46 then facilitating the return of the lid member 24 to its normal, closed position. Thereafter, the cover member 74 is pulled downwardly toward the lid member 24 to return the same to its first position covering the lid member 24.

Once the containment bag 22 has been filled with diapers or other disposable sanitary products, the top section 16 of the frame member 12 is detached from the base section 14 thereof in the previously described manner. The containment bag 22 is then grasped and pulled downwardly so as to remove the upper portion thereof from about the top rim of the base section 14. A replacement containment bag 22 is then inserted into the frame member 12, with the upper portion thereof being rolled over the top edge of the base section 14. The top section 16 is then re-attached to the base section 14, thus making the containment system 10 ready for continued usage in relation to the disposal of diapers or other disposable sanitary products. From time to time, the deodorizing element disposed within the fragrance container 68 is replaced simply by removing the cover plate 72 from the distal rim of the housing 70, and re-attaching the cover plate 72 thereto subsequent to the replacement of the deodorizing element.

Additional modifications and improvements of the present invention may also be apparent to those skilled in the art. Thus, the particular combination of parts described and illustrated herein is intended to represent only certain embodiments of the present invention, and is not intended to serve as limitations of alternative devices within the spirit and scope of the invention.

What is claimed is:

1. A containment system for receiving and disposing of disposable sanitary products, comprising:

a peripheral frame member including a base section and a top section which defines a central opening and is releasably attached to the base section;

a containment bag captured between the top and base sections of the frame member in a manner wherein the containment bag is suspended therefrom, the containment bag defining a hollow interior which communicates with the frame member;

a lid member pivotally connected to the top section of the frame member and movable between a closed position whereat the lid member blocks the central opening and an open position whereat disposable sanitary products are passable through the central opening of the frame member into the interior of the containment bag; and a biasing mechanism attached to and extending between the top section of the frame member and the lid member for normally maintaining the lid member in the closed position;

the frame member being sized relative to the containment is uncovered and bag such that a substantial portion of the containment bag protrudes downwardly from the frame member.

2. The containment system of claim 1 wherein the top section of the frame member includes a sealing gasket attached thereto, said lid member being abutted against the sealing gasket when in the closed position for facilitating an odor-tight seal of the central opening defined by the top section of the frame member.

3. The containment system of claim 1 wherein said lid member includes a fragrance container integrally formed thereon which resides within the frame member when the lid member is in the closed position.

4. The containment system of claim 3 wherein said fragrance container includes a perforated cover plate which is removably attached thereto and encloses a hollow reservoir defined thereby.

5. The containment system of claim 1 further comprising a cover member pivotally connected to the top section of the frame member and moveable between a first position whereat the lid member is covered thereby and a second position whereat the lid member is exposed.

6. The containment system of claim 5 wherein said cover member includes at least one retention tab formed thereon for frictionally maintaining the cover member in the second position.

7. The containment system of claim 1 further comprising a mounting bracket releasably attached to the base section of the frame member for facilitating the attachment of the frame member to a vertically oriented support surface.

8. The containment system of claim 1 further comprising a hanger member releasably attached to the base section of the frame member for facilitating the suspension of the frame member from a horizontally extending support structure.

9. The containment system of claim 1 wherein:

the top section of the frame member includes a pair of flexible tab portions formed thereon; and the base section of the frame member includes a pair of connector lugs formed thereon;

said tab portions being engagable to respective ones of said connector lugs for facilitating the releasable attachment of the top section to the base section.

10. The containment system of claim 1 wherein said biasing mechanism comprises:

a rod member attached to said lid member; and a coil spring disposed on said rod member and including a first end which is abutted against said lid member and a second end which is abutted against the top section of the frame member.

* * * * *